US006904877B2

(12) United States Patent
Stokes

(10) Patent No.: US 6,904,877 B2
(45) Date of Patent: Jun. 14, 2005

(54) PISTON MOTION MODIFIABLE INTERNAL COMBUSTION ENGINE

(76) Inventor: Warwick James Stokes, P.O. Box 182, Mullumbimby 2482 (AU)

( * ) Notice: Subject to any disclaimer, the term of this patent is extended or adjusted under 35 U.S.C. 154(b) by 133 days.

(21) Appl. No.: 10/240,900

(22) PCT Filed: Apr. 6, 2001

(86) PCT No.: PCT/AU01/00397

§ 371 (c)(1),
(2), (4) Date: Oct. 25, 2002

(87) PCT Pub. No.: WO01/77494

PCT Pub. Date: Oct. 18, 2001

(65) Prior Publication Data

US 2004/0050347 A1 Mar. 18, 2004

(30) Foreign Application Priority Data

Apr. 7, 2000 (AU) ..... PQ6767

(51) Int. Cl.[7] ..... F01B 9/06
(52) U.S. Cl. ..... 123/54.3
(58) Field of Search ..... 123/52.2–52.6, 123/54.3, 44 B, 44 E; 91/492–498

(56) References Cited

U.S. PATENT DOCUMENTS 1,087,240 A * 2/1914 Kellington ..... 123/51 A
1,252,757 A * 1/1918 Williams ..... 123/51 A
3,964,450 A * 6/1976 Lockshaw ..... 123/54.3
3,967,599 A * 7/1976 Townsend ..... 123/44 D
4,334,506 A 6/1982 Albert
4,974,553 A * 12/1990 Murray et al. ..... 123/44 B

FOREIGN PATENT DOCUMENTS

| | | |
|---|---|---|
| DE | 3907307 | 9/1990 |
| GB | 2341206 | 3/2000 |
| WO | WO 87/03041 | 5/1987 |
| WO | WO 90/06424 | 6/1990 |
| WO | WO 98/49437 | 11/1998 |

* cited by examiner

*Primary Examiner*—Marguerite McMahon
(74) *Attorney, Agent, or Firm*—Graybeal Jackson Haley LLP

(57) ABSTRACT

An internal combustion engine (10) including at least two radial cylinders (17) disposed with their axes coplanar and equi-angular located relative to each other. The cylinders (17) meet to form a common combustion chamber (18). A piston (20) is located in each of the cylinders (17), each piston (20) cooperates with a cam profile (23) formed by the inner wall of a rotor (13). The cam profile (23) is rotationally symmetrical and includes the same number of lobes (26) as pistons (20) with each lobe (26) projecting radially inwards. The lobes are equi-angularly disposed about the inner wall of the rotor (13). In contrast to a conventional crankshaft driven engine, the cammed pistons (20) may move according to a non-sinusoidal time-velocity function. The lobes (26) may be modified in shape, for example, by filing or other reshaping, in order to customize the pattern of movement of the pistons (20) so as to alter the operating characteristics of the engine (10). In particular the lobes (26) may be re-shaped until an optimal efficiency is obtained.

5 Claims, 3 Drawing Sheets

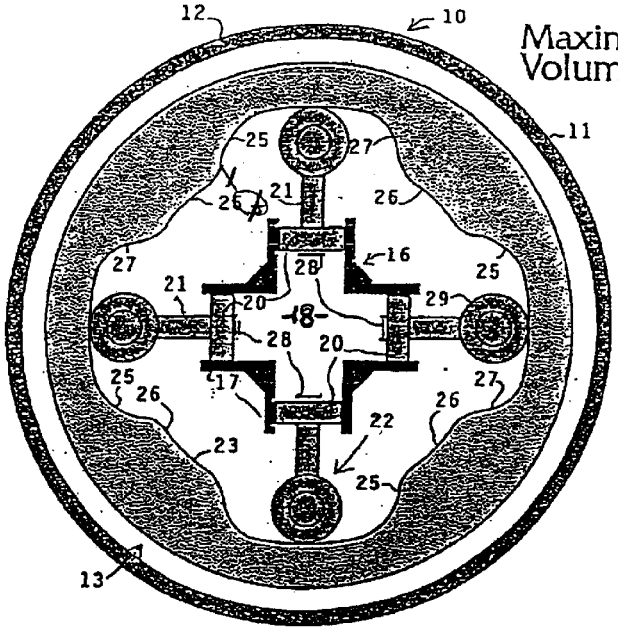
FIG. 1
FIG. 1A
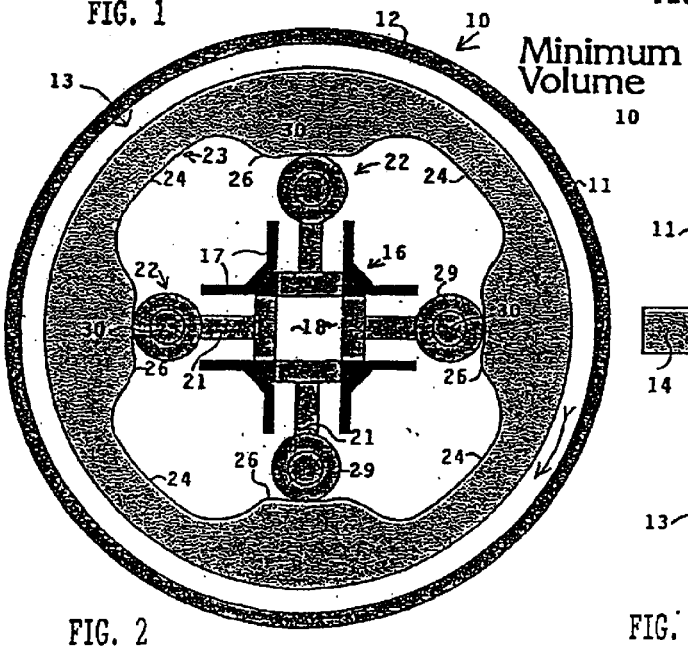
FIG. 2
FIG. 2A
Legend: Rotor Stator Reciprocator Housing

Time/Displacement Graph of Twostroke Crank Engine

Time/Displacement Graph of Hub Engine

Open Chamber Closed Chamber

PISTON MOTION MODIFIABLE INTERNAL COMBUSTION ENGINE

FIELD OF THE INVENTION

This invention relates to improvements to internal combustion engines. The invention particularly relates to an engine configuration in which the rate of compression and expansion of the combustion chamber may be readily modified.

BACKGROUND

The most common type of existing internal combustion engines include pistons connected via conrods to a crankshaft, whereby the pistons reciprocate cyclically within respective cylinders to perform the functions of induction, compression, expansion and exhaust of the working fluid.

Work is extracted from the working fluid by the combustion process wherein the expanding combusted gases resulting from combustion of the compressed working fluid forces the piston through the cylinder forcing rotation of the crankshaft.

The rotating mass of the crankshaft enables energy to be stored. The stored energy is applied to enable the piston to perform work on the working fluid in order to compress it prior to the combustion process. The work performed during compression, which is hereinafter referred to as "negative" work, reduces the total work which can be extracted via the engine's crankshaft.

This "negative" work is significantly increased if the combustion process commences during the compression process. In addition, any heat loss from the products of combustion of the working fluid are energy losses which cannot be converted into useful work extractable from the crankshaft.

In conventional engines the rate of change of the combustion chamber's volume during compression and expansion varies identically and sinusoidally. That is, the time-volume function of the combustion chamber, which is directly related to the time-displacement function of the piston, is sinusoidal. In particular, the piston has greatest velocity during the middle of each stroke and instantaneously zero velocity at the top and bottom of each stroke.

However, in the combustion process pressure increases rapidly due to the rapid production of combustion gases. The combustion gases then behave substantially in accordance with the gas laws. The result in conventional engines is a non-adiabatic expansion of the combustion gases as the initial slow movement of the piston and thus expansion of the working chamber prevents initial fast expansion of the working fluid.

The slow initial movement of the piston results in significant pressure and temperature increases which are believed to cause consequent massive heat losses through the walls of the working chamber. Accordingly the efficiency of the conventional petrol engine in converting chemical energy released by combustion into useable mechanical energy is only about 25%.

In effect, the conventional crankshaft driven piston is systematically misplaced throughout its cycle in relation to the behaviour of the products of combustion. While it is possible to vary, for example, the stroke length of the sinusoidal motion of the piston in the engine cylinder of a conventional engine, no modification will alter time-displacement function of the piston, and hence the time-volume function of the combustion chamber, from being sinusoidal in form. Accordingly it is not possible to readily alter a conventional engine so that the time-displacement function is not sinusoidal but is of some other form which may provide for greater engine efficiency.

Furthermore, while the crankshaft mechanism for internal combustion engines has many desirable features, such as simplicity, strength and reliability, it has mechanical disadvantages such as being unbalanced resulting in vibration.

The present invention aims to provide an internal combustion engine which is configured to allow the time-displacement function of the combustion chamber to be changed by a straightforward modification.

SUMMARY OF THE INVENTION

According to a first aspect of the invention there is provided an internal combustion engine including:

at least three radial cylinders disposed with their axes coplanar and equi-angularly disposed about a point common to each axis, the cylinders meeting to form a common combustion chamber;

a piston located in each of said radial cylinders, each piston cooperating with a cam profile formed by the inner wall of a rotor, the cam profile being rotationally symmetrical and including the same number of lobes as pistons, each lobe projecting radially inwards, the lobes equi-angularly disposed about the inner wall.

In operation, the pistons may mutually expand/compress the combustion chamber in accordance with other than a sinusoidal time-displacement function.

Preferably the engine includes an output shaft collinear with the engine axis drivingly connected to the rotor.

Alternatively the rotor may be fixed with the cylinders and pistons rotatable, in that case the output shaft may be drivingly connected, to the cylinders.

As a further alternative the rotor may be rotatable and have an armature winding for inclusion as part of an electric generator.

The engine may include poppet valves to regulate the introduction and exhaust of fluids from the cylinders.

The engine may be provided with a number of interchangeable rotors having differently shaped lobes.

The engine may be incorporated into a vehicle.

Preferably the engine includes ignition timing means arranged to operatively cause ignition to commence upon the pistons being cammed to a top-dead centre position at which the common combustion chamber is minimised.

It is preferred that each lobe be shaped with an innermost extent defining a camming surface of constant radial distance from the first axis thereby causing each piston to maintain a top dead centre position for a non-zero period of time.

The engine may be operated as a ported two stroke engine with low profile ports at the bottom of the cylinder such that the effective stroke of the piston compared to a conventional two stroke engine is substantially increased. Due to the circular configuration of the rotor there is a cessation of piston while between camming by the lobes so that maximum expansion of the combustion chamber may be prolonged. By prolonging the maximum expansion of the combustion chamber, effective scavenging of the exhaust gases from the cylinder, before the next compression stroke commences, is possible.

In an engine of the type described the cam profile may be changed by reshaping the lobes, or replacing the rotor with another rotor having a varied lobe shape, until a cam profile which maximises engine efficiency for a particular engine configuration, operational speed or fuel type is found.

Altering the shape of the lobes may be achieved by filing or otherwise machining or shaping the lobes.

The expansion and compression strokes need not be mirror images of one another. Unlike a conventional crankshaft engine, the piston speed need not peak at mid-stroke and there can be a multitude of acceleration patterns depending upon the shape of the lobes. The cam profile may be chosen to maximise efficiency for a particular class of engine depending on the scale of the engine, the fuel burned, the compression ratio chosen and the thermal properties of the materials used for building the engine.

As the engine uses radially disposed cylinders sharing a common combustion chamber and is arranged with the cylinders and pistons being rotationally symmetrical, the design is balanced so that vibration is minimised.

If the engine is to be operated in a four stroke mode then it is not essential that all the lobes be of identical shape. For example, in a four stroke engine having four cylinders the lobes camming the pistons during the exhaust and intake strokes may be of similar or identical shape whereas the lobes for camming the pistons during the compression and power strokes may be of another shape.

Operation in a four stroke mode entails the inclusion of valves and valve opening means arranged to facilitate introduction and exhaust of working fluids into and out of the combustion chamber and also to close the combustion chamber during the compression and power strokes.

According to a further aspect of the invention there is provided a method for maximising the efficiency of an engine of the type described above, the method including the steps of:

measuring the efficiency of the engine;

modifying the shape of the lobes;

repeating the steps of measuring and modifying until a desired level of efficiency is obtained.

BRIEF DESCRIPTION OF THE FIGURES

In order that this invention may be more readily understood and put into practical effect, reference will now be made to the accompanying drawings which illustrate a preferred embodiment and wherein.

DETAILED DESCRIPTION OF PREFERRED EMBODIMENTS

Figure 1A:
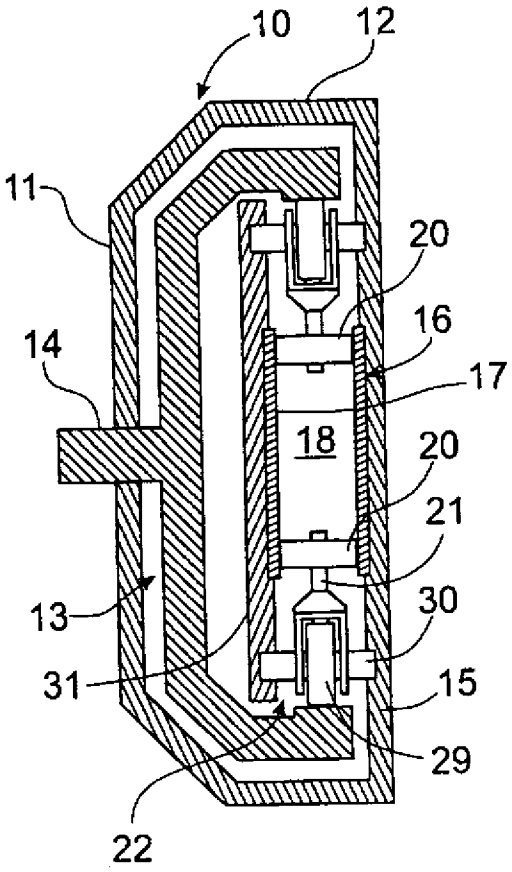
FIG. 1A is a side view of the engine of FIG. 1.
Figure 1:
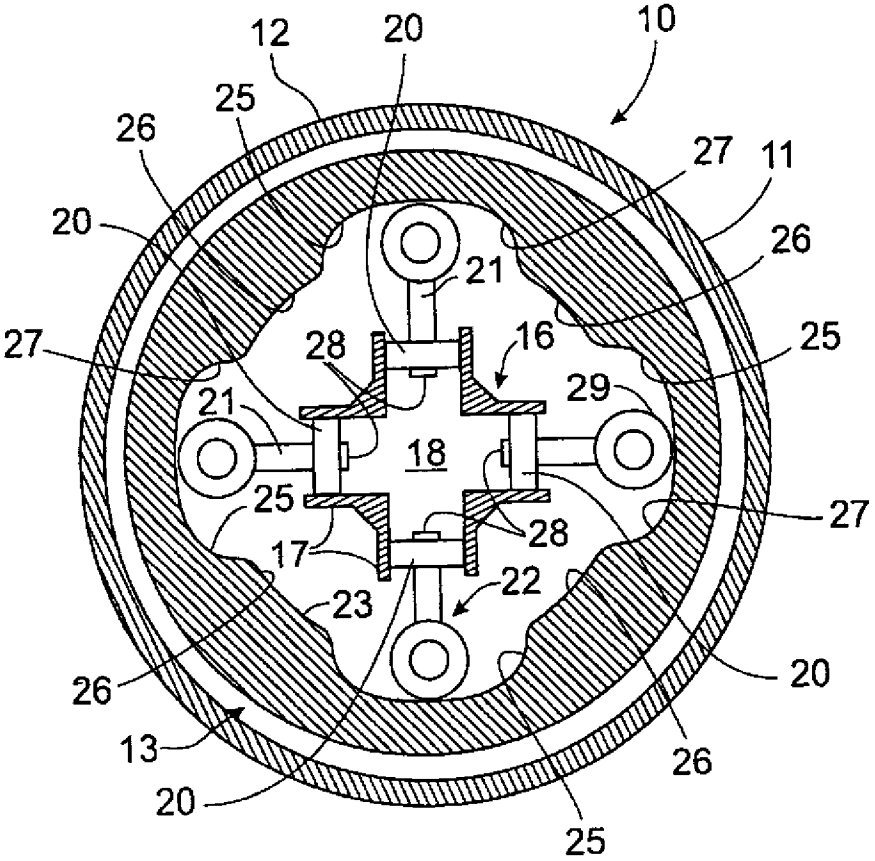
FIG. 1 diagrammatically illustrates an engine according to an embodiment of the present invention in front view with the pistons disposed at maximum cylinder chamber volume.
Figure 2A:
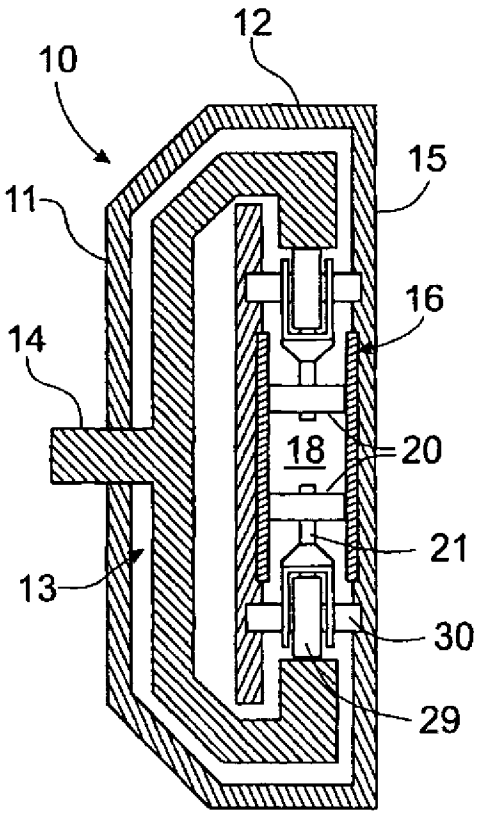
FIG. 2A is a side view of the engine of FIG. 2.
Figure 2:
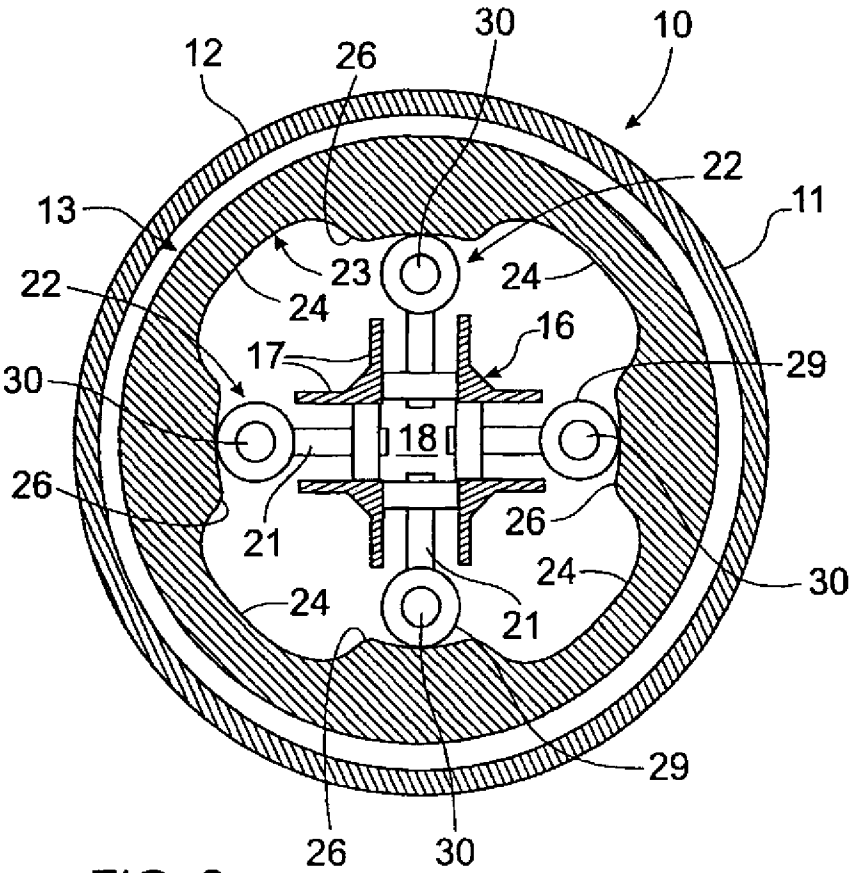
FIG. 2 is a front view of the engine of FIG. 1 with the pistons disposed at a position for minimum cylinder chamber volume.
Figure 3:
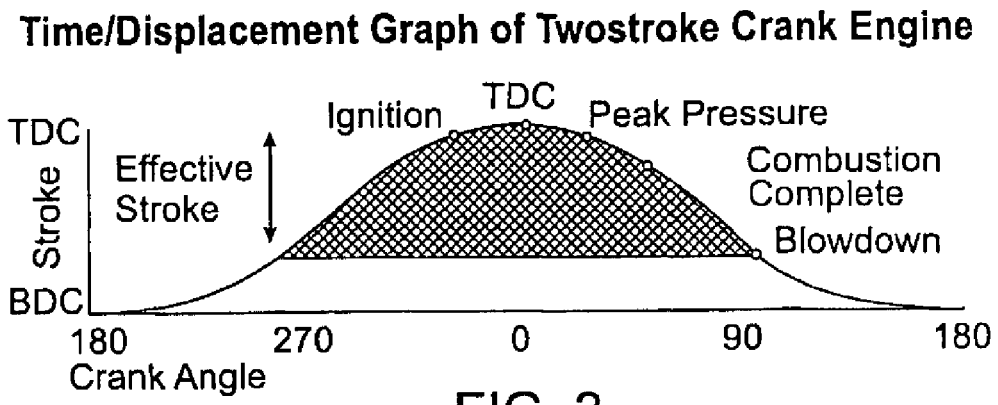
Figure 4:
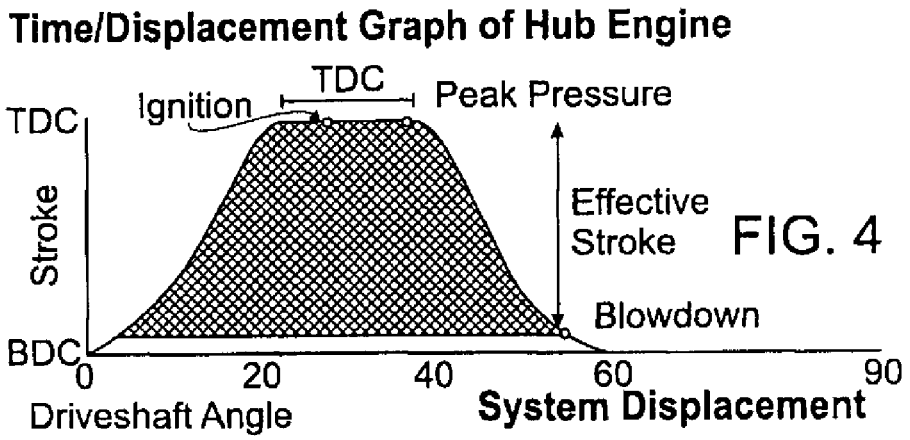
Figure 5:
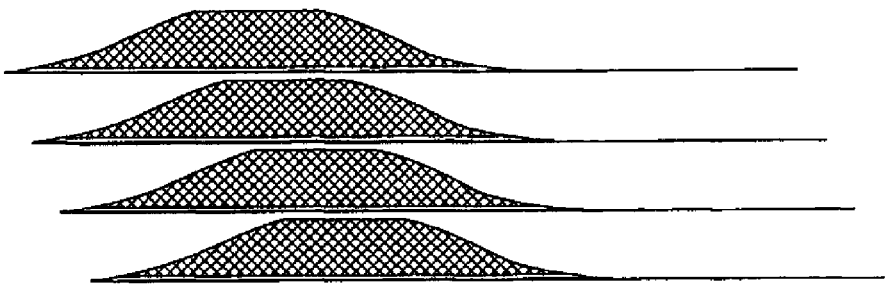
Figure 6:
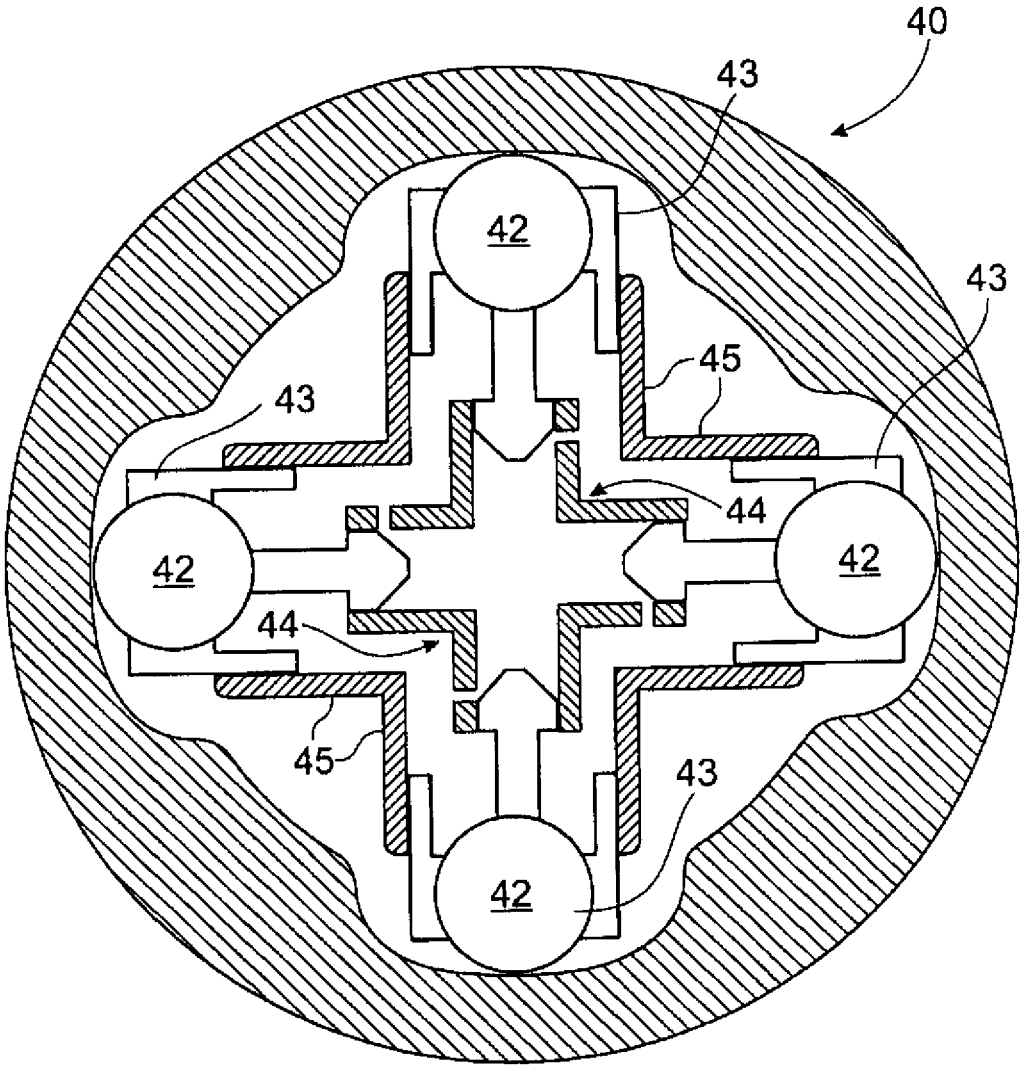

Referring now to FIGS. 1 and 2, the inner structure of an engine according to an embodiment of the present invention is depicted. Engine 10 has an outer housing 11 provided with an annular side wall 12 which surrounds a rotor assembly 13 mounted rotatably in housing 11 on an output shaft 14.

The housing 11 has a front wall 15 which supports a branched cylinder assembly 16 having four cylinders 17 disposed in a common plane and equi-angularly disposed at 90 degrees to each other. Each cylinder 17 opens to a common combustion chamber 18.

Respective pistons 20 are slidably arranged in each cylinder 17 and each is interconnected by a respective conrod 21 to a roller assembly 22 having its rolling surface in contact with an internal cam profile 23 formed on the inside of the rotor assembly 13. It will be seen that the cam profile 23 has four base segments 24 spaced equally along the periphery of the profile 23 and four equally spaced peak segments 26 or "lobes".

It will be understood that the term "lobe" when used herein in both the description and the claims is intended to refer to profile segments for bringing the pistons to a position where the combustion chamber is minimised.

The base and peak segments extend at a constant radius whereby the roller assemblies 22 may move without displacing the pistons 20 in the cylinders 17.

The constant radius base segment 24 and peak segments 26 are interconnected by ramp segments including leading ramp segments 25 which, upon clockwise rotation of the rotor assembly 13, simultaneously force the pistons to move from their maximum expansion positions, (bottom dead centre) illustrated in FIG. 1 to their maximum compression positions (top dead centre) illustrated in FIG. 2. Roller assemblies 22 subsequently cam over trailing ramps 27 as the pistons 20 return to maximum expansion positions under the influence of gas pressure in the combustion chamber 18.

Although not illustrated, an inlet is provided to the combustion chamber for admission of the air/fuel mixture or air if direct fuel injection is utilised and a spark plug if the engine is adapted as a spark ignition engine. The fuel/air mixture may be introduced in any known and suitable manner. Suitably the engine operates as a two-stroke and a low profile exhaust port 28 is provided at the base of each cylinder. A spark plug is suitably positioned in the cylinder wall substantially concentric with the drive shaft axis and an inlet port or ports may be piston controlled or valve controlled as desired.

In the illustrated embodiment, each conrod 21 is forked to support the roller axle 30 at opposite sides of the roller 29 and to enable the roller axle 30 to extend outwardly beyond the conrod for engagement in linear slots 31 which maintain the axis of the roller in alignment with the axis of the respective cylinder 17.

Suitably the conrods 21 are connected to the pistons 20 via a pin connection at right angles to the axles 30 such that in effect, the conrod provides a universal connection between each roller assembly 22 and the respective piston with a view to minimising any piston side loads which may result in use from slight misalignment of the moving parts. It will be seen that as the cam profile 23 on the rotor assembly 13 moves relative to the rollers 22 each roller 22 is simultaneously contacted by a leading ramp segment 25 forcing the pistons inwardly to maximum compression positions at which they are held by the peak segments 26 during further rotation of the rotor until the rollers 22 travel there across to the trailing segments 27 allowing the pistons 20 to move back to maximum expansion positions at which they rest while the rollers 22 move along the base segments 24 prior to contacting the next leading ramp segment 25 when the cycle is repeated.

From the above it will be seen that the cam profile 23 may be configured to achieve variations in the time-displacement function followed by a piston during each cycle. Consequently the combustion chamber may expand and compress in accordance with other than a sinusoidal time-displacement function as is the case in conventional crank shaft driven engines. Furthermore the cam profile may be configured to enable the engine 10 to realise a desired time-displacement function in order that the piston's motions conform to a selected energy management program.

A graph of a time-displacement function for a two stroke crank shaft-driven engine appears in FIG. 2. It will be seen that ignition occurs while the piston is on the up stroke thus causing the piston to work against the products of combustion. Furthermore, peak combustion pressure is achieved after partial expansion of the working chamber has commenced thus reducing the power which may be extracted from the engine and that the exhaust port opens at the point marked 'blow down' well before the piston has reached its bottom dead centre position. The timing of events in the graph of FIG. 2 is necessary to allow sufficient open duration for the exhaust gases to escape or be extracted so that they do not significantly contaminate the fresh incoming charge.

Figure 3:
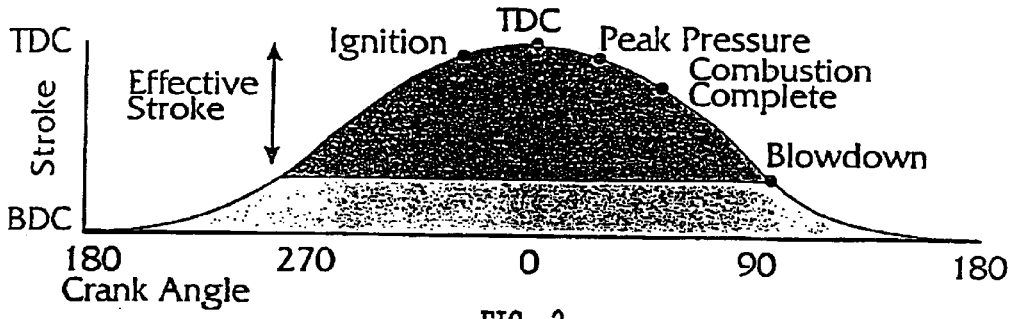
FIG. 3 is a time/displacement graph of a conventional two-stroke crank engine.
Figure 4:
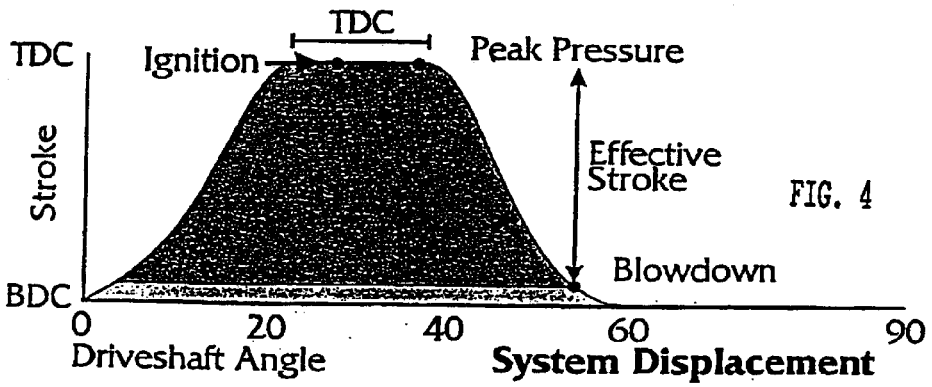
FIG. 4 is a time displacement graph of the engine of FIG. 1.
Figure 5:
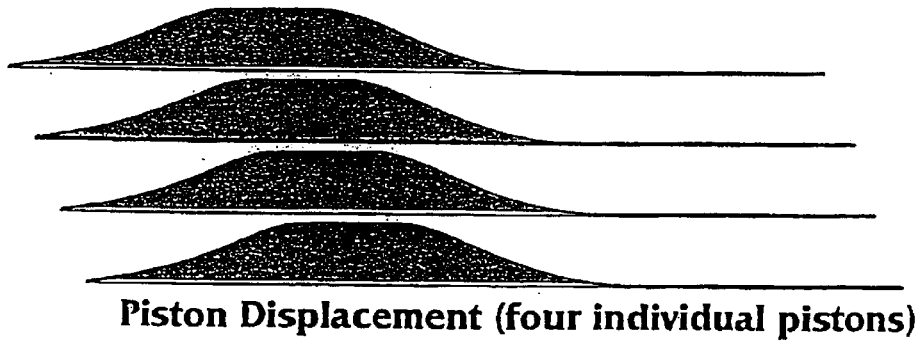
FIG. 5 is an illustration of the relative displacements of the four pistons of the engine of FIG. 1.

By comparison FIG. 4 is a graph of a preferred time-displacement function for an engine according to the present invention. It will be seen that compression occurs rapidly during a relatively small rotation of the rotor/output shaft and that ignition occurs while the combustion gases are held at a constant volume and that the low profile port enables a much fuller working expansion of the products of combustion. This is possible as the low profile port remains open for a longer period while the rollers travel along the respective base segments of the cam profile.

Furthermore as the pistons move in unison and in opposite directions while performing their same functions and shared gas is bearing on all of the pistons at any time throughout the cycle, the pressure on each piston at any instant will be the same. Thus the engine should operate with less harsh vibrations than comparable conventional engine.

In a preferred embodiment of the invention the engine fires (n) times per revolution. The forces on individual components is low because it is shared. If there are four pistons, they will deliver four impulses to the rotor at every firing, and as there are four firings per revolution, there are sixteen impulses per revolution from a single chamber.

Each engine has a characteristic number which equals:

the number of lobes of the rotor cam profile;

the number of branches in cylinders;

the number of pistons and roller assemblies, and the number of firings per revolution.

The choice of this characteristic number will depend on the designer's purposes. However it is considered that as this characteristic number increases so too does the number of parts, the operating torque, while the RPM, the length of the stroke, the piston speed, the engine diameter and the loads on individual components decreases along with wear factors.

Figure 6:
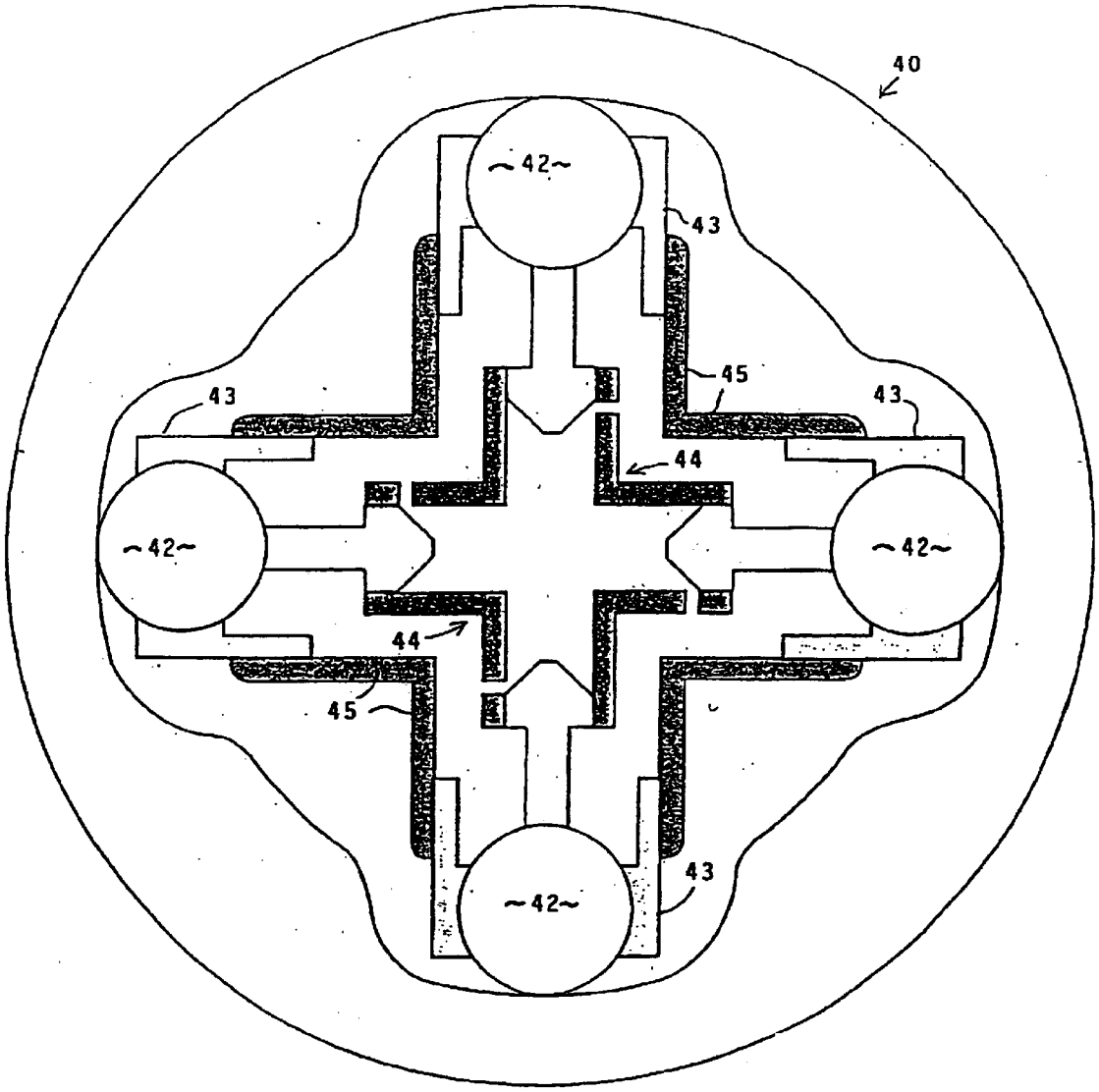
FIG. 6 illustrates a further embodiment of an engine according to the present invention.

The engine 40 illustrated in FIG. 6 shows the rollers 42 guided in sliders 43 for movement to and from the cylinders 44. The sliders 43 could form pistons sliding in guide cylinders 45 so as to be capable of developing pumping chambers for charging the cylinders 44 such as in the manner of conventional crankcase compression or otherwise as desired.

Alternatively an external supply of pressurised air or air/fuel mix, or a further similar engine bank or supercharger or turbocharger may be used for charging the working cylinders.

It will be seen that an engine according to this invention can be configured so that the chamber volume at any given time is optimised to regulate the energy released through combustion, the energy captured through resisted expansion and energy lost through heat transfer into the chamber walls. Thus temperature of the working fluid may be raised to its desired level as quickly as practicable, and then expanded quickly before too much thermal energy dissipates into the walls of the working chamber.

It will also be seen that the location and the velocity of the pistons is not, for design purposes, fixed to the output shaft rotation angle, making these parameters adjustable. Consequently it is possible to shape the cam profile in working fluid may be raised to its desired level as quickly as practicable, and then expanded quickly before too much thermal energy dissipates into the walls of the working chamber.

It will also be seen that the location and the velocity of the pistons is not, for design purposes, fixed to the output shaft rotation angle, making these parameters adjustable. Consequently it is possible to shape the cam profile in order to realise piston time-displacement functions which result in variations in combustion chamber tailored to create the preferred combination of process variables at any stage in the cycle. Temperature and pressure are functions of volume, so by controlling volume change it is possible to manage the conditions inside the combustion chamber.

Thus it is believed that the processes of thermal energy release, thermal energy escape and thermal energy capture can be co-ordinated, so as to give preferred patterns of emission and fuel efficiency.

For example, an engine according to an embodiment of the invention may be tested for fuel efficiency, the lobe shapes may then be modified, for example by filing in order to alter the time-displacement function followed by the piston until a desired fuel efficiency or other operating parameter is obtained.

The use of multiple pistons pushing and being pushed by a common volume of gas permits faster expansion rates with slower piston speeds. It also allows high expansion ratios with shorter individual piston strokes.

The radially symmetrical design allows radial opposition of both reciprocating and rotating parts, so there is no need for counterweights. In addition because of the concentric design and the simultaneous action of opposed pistons, the preferred engine is balanced, so heavy casting and counterweights are unnecessary. This leads to saving in engine weight. However designs other than concentric layouts may be utilised if desired such as conventional in-line arrangements with cams operating the pistons.

It will of course be realised that the above has been given only by way of illustrative example of the invention. Although in the embodiment depicted there are four cylinders other configurations are possible. For example a three cylinder variant may be constructed with the cylinders disposed at 120 degrees to each other. Furthermore, rather than extract mechanical energy from the engine the rotor could have an armature winding around it and form part of an electrical generator in which case power would be available in electrical form.

While the engine described in the embodiment of FIGS. 1 and 2 is intended for operation in a two-stroke mode, other embodiments may be configured to operated in dedicated four stroke mode.

If the engine is to be operated in a four stroke mode then it is not essential that all the lobes be of identical shape. For example, in a four stroke engine having four cylinders the lobes camming the pistons during the exhaust and intake strokes may be of similar or identical shape whereas the lobes for camming the pistons during the compression and power strokes may be of another shape.

It will be understood that an engine in accordance with an embodiment of the present invention may find application as a power unit for a vehicle.

All other modifications and variations thereto as would be apparent to persons skilled in the art are deemed to fall within the broad scope and ambit of the invention as is set forth in the following claims.

What is claimed is:

1. An internal combustion engine comprising:

at least three radial cylinders disposed with their axes coplaner and equi-angularly disposed about a point common to each axis, the cylinders meeting to form a common combustion chamber;

a piston located in each of said radial cylinders, each piston cooperating with a cam profile formed by the inner wall of a rotor, the cam profile being rotationally symmetrical and including the same number of lobes as pistons, each lobe projecting radially inwards, the lobes equi-angularly disposed about the inner wall, and wherein said rotor is fixed and the cylinders and pistons are rotatable, and an output shaft is drivingly connected to the cylinders.

2. An internal combustion engine comprising:

at least three radial cylinders disposed with their axes coplaner and equi-angularly disposed about a point common to each axis, the cylinders meeting to form a common combustion chamber;

a piston located in each of said radial cylinders, each piston cooperating with a cam profile formed by the inner wall of a rotor, the cam profile being rotationally symmetrical and including the same number of lobes as pistons, each lobe projecting radially inwards, the lobes equi-angularly disposed about the inner wall, and wherein the engine is provided with a number of interchangeable rotors having differently shaped lobes.

3. An internal combustion engine comprising:

at least three radial cylinders disposed with their axes coplaner and equi-angularly disposed about a point common to each axis, the cylinders meeting to form a common combustion chamber;

a piston located in each of said radial cylinders, each piston cooperating with a cam profile formed by the inner wall of a rotor, the cam profile being rotationally symmetrical and including the same number of lobes as pistons, each lobe projecting radially inwards, the lobes equi-angularly disposed about the inner wall, and wherein each lobe is shaped with an innermost extent defining a camming surface of constant radial distance from the first axis thereby operatively causing each piston to maintain substantially a top dead centre position for a non-zero period of time.

4. A method for maximising the efficiency of an internal combustion engine including at least three radial cylinders disposed with their axes coplanar and equi-angularly disposed about a point common to each axis, the cylinders meeting to form a common combustion chamber; a piston located in each of said radial cylinders, each piston cooperating with a cam profile formed by the inner wall of a rotor, the cam profile being rotationally symmetrical and including the same number of lobes as pistons, each lobe projecting radially inwards, the lobes equi-angularly disposed about the inner wall, the method comprising the steps of:

measuring the efficiency of the engine;

modifying the shape of the lobes;

repeating the steps of measuring and modifying until a desired level of efficiency is obtained.

5. A method for maximising the efficiency of an engine according to any one of claims 1, 2, or 3, the method comprising the steps of:

measuring the efficiency of the engine;

modifying the shape of the lobes;

repeating the steps of measuring and modifying until a desired level of efficiency is obtained.

* * * * *

UNITED STATES PATENT AND TRADEMARK OFFICE

CERTIFICATE OF CORRECTION

PATENT NO. : 6,904,877 B2
APPLICATION NO. : 10/240900
DATED : June 14, 2005
INVENTOR(S) : Stokes It is certified that error appears in the above-identified patent and that said Letters Patent is hereby corrected as shown below:

The title page showing the illustrative figure should be deleted to be replaced with the attached title page.

The drawing sheets, consisting of Figs. 1-6, should be deleted to be replaced with the drawing sheets, consisting of Figs. 1-6, as shown on the attached pages.

Signed and Sealed this

Tenth Day of November, 2009

David J. Kappos

David J. Kappos
*Director of the United States Patent and Trademark Office*

(12) United States Patent
Stokes

(10) Patent No.: US 6,904,877 B2
(45) Date of Patent: Jun. 14, 2005

(54) PISTON MOTION MODIFIABLE INTERNAL COMBUSTION ENGINE

(76) Inventor: Warwick James Stokes, P.O. Box 182, Mullumbimby 2482 (AU)

( * ) Notice: Subject to any disclaimer, the term of this patent is extended or adjusted under 35 U.S.C. 154(b) by 133 days.

(21) Appl. No.: 10/240,900

(22) PCT Filed: Apr. 6, 2001

(86) PCT No.: PCT/AU01/00397

§ 371 (c)(1),
(2), (4) Date: Oct. 25, 2002

(87) PCT Pub. No.: WO01/77494

PCT Pub. Date: Oct. 18, 2001

(65) Prior Publication Data

US 2004/0050347 A1 Mar. 18, 2004

(30) Foreign Application Priority Data

Apr. 7, 2000 (AU) ..... PQ6767

(51) Int. Cl.[7] ..... F01B 9/06
(52) U.S. Cl. ..... 123/54.3
(58) Field of Search ..... 123/52.2–52.6, 123/54.3, 44 B, 44 E; 91/492–498

(56) References Cited

U.S. PATENT DOCUMENTS 1,087,240 A * 2/1914 Kellington ..... 123/51 A
1,252,757 A * 1/1918 Williams ..... 123/51 A
3,964,450 A * 6/1976 Lockshaw ..... 123/54.3
3,967,599 A * 7/1976 Townsend ..... 123/44 D
4,334,506 A 6/1982 Albert
4,974,553 A * 12/1990 Murray et al. ..... 123/44 B

FOREIGN PATENT DOCUMENTS

| | | |
|---|---|---|
| DE | 3907307 | 9/1990 |
| GB | 2341206 | 3/2000 |
| WO | WO 87/03041 | 5/1987 |
| WO | WO 90/06424 | 6/1990 |
| WO | WO 98/49437 | 11/1998 |

* cited by examiner

*Primary Examiner*—Marguerite McMahon
(74) *Attorney, Agent, or Firm*—Graybeal Jackson Haley LLP

(57) ABSTRACT

An internal combustion engine (10) including at least two radial cylinders (17) disposed with their axes coplanar and equi-angular located relative to each other. The cylinders (17) meet to form a common combustion chamber (18). A piston (20) is located in each of the cylinders (17), each piston (20) cooperates with a cam profile (23) formed by the inner wall of a rotor (13). The cam profile (23) is rotationally symmetrical and includes the same number of lobes (26) as pistons (20) with each lobe (26) projecting radially inwards. The lobes are equi-angularly disposed about the inner wall of the rotor (13). In contrast to a conventional crankshaft driven engine, the cammed pistons (20) may move according to a non-sinusoidal time-velocity function. The lobes (26) may be modified in shape, for example, by filing or other reshaping, in order to customize the pattern of movement of the pistons (20) so as to alter the operating characteristics of the engine (10). In particular the lobes (26) may be re-shaped until an optimal efficiency is obtained.

5 Claims, 3 Drawing Sheets

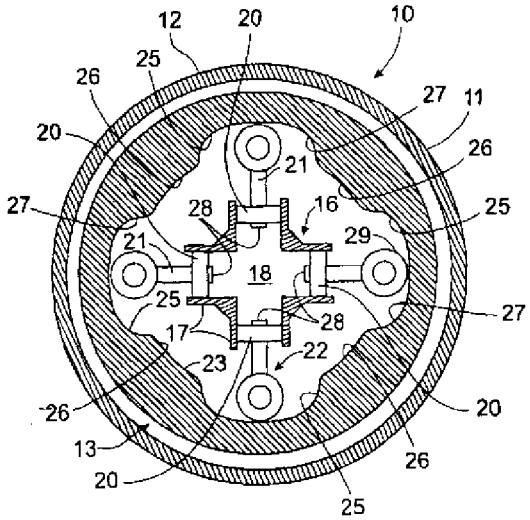

Piston Displacement (four individual pistons)

Open Chamber Closed Chamber